United States Patent [19]

Hinden et al.

[11] Patent Number: 4,517,068

[45] Date of Patent: May 14, 1985

[54] ELECTROCATALYTIC ELECTRODE

[75] Inventors: Jean M. Hinden, Chambesy, Switzerland; Lynne M. Ernes, Euclid; Patrick E. Visel, North Madison, both of Ohio

[73] Assignee: Eltech Systems Corporation, Boca Raton, Fla.

[21] Appl. No.: 527,552

[22] PCT Filed: Dec. 28, 1981

[86] PCT No.: PCT/US81/01763

§ 371 Date: Aug. 26, 1983

§ 102(e) Date: Aug. 26, 1983

[87] PCT Pub. No.: WO83/02288

PCT Pub. Date: Jul. 7, 1983

[51] Int. Cl.[3] ..... C25B 11/03; C25B 11/00

[52] U.S. Cl. ..... 204/283; 204/282; 204/290 F

[58] Field of Search ..... 204/290 F, 291, 292, 204/282, 283

[56] References Cited

U.S. PATENT DOCUMENTS

| | | | |
|---|---|---|---|
| 3,562,008 | 2/1971 | Martinsons | 204/290 F |
| 3,645,862 | 2/1972 | Cotton et al. | 204/290 F |
| 3,778,307 | 12/1973 | Beer | 204/290 F |
| 3,948,751 | 4/1976 | Bianchi | 204/290 F |
| 4,157,943 | 6/1979 | Scarpellino | 204/292 |

OTHER PUBLICATIONS

Saito et al., Chem. Absts., 86: 196959n, (Jap. Pat. Appl. Open No. 51-116182).

*Primary Examiner*—John F. Niebling
*Attorney, Agent, or Firm*—Arthur S. Collins

[57] ABSTRACT

An electrode, especially for chlorine and hypochlorite production, comprises an electrocatalyst consisting of 22–55 mol % ruthenium oxide, 0.2–22 mol % palladium oxide and 44–77.8 mol % titanium oxide. The electrocatalyst may form a coating on a valve metal substrate and may be topcoated with a porous layer of titanium or tantalum oxide.

10 Claims, No Drawings

ELECTROCATALYTIC ELECTRODE

TECHNICAL FIELD

The invention relates to electrodes of the type comprising an electrocatalyst based on the oxides of ruthenium, palladium and titanium.

BACKGROUND ART

The use of platinum-group metal oxides as electrocatalytic coatings on titanium and other valve metal electrodes was first described in U.K. Patent Specification No. 1 147 442 which recognized the particularly advantageous properties of palladium oxide. Subsequently, U.K. Patent Specification No. 1 195 871 proposed coatings formed as a mixed-crystal or solid-solution of a valve-metal/platinum-group metal oxide, and such coatings in particular ruthenium-titanium oxide coatings have been very widely used on so-called dimensionally stable anodes in mercury, diaphragm and membrane cells for chlorine production. Example VII of the latter patent proposed a palladium-tantalum oxide coating for cathodic protection or hypochlorite preparation, but this coating has not met with success.

Many efforts have subsequently been made to provide electrodes with a palladium oxide based electrocatalyst, but without great success.

For example, Japanese Patent Application Open No. 51-56783 proposed a coating of 55–95 mol % PdO and 5–45 mol % $RuO_2$, but these coatings have a very poor lifetime, and an attempt to remedy this was to provide an underlayer e.g. of $RuO_2.TiO_2$ (Japanese Patent Application Open No. 51-78787). Another suggestion, in Japanese Patent Application Open No. 51-116182, was a coating consisting of 3–65 mol % PdO, 3–20 mol % $RuO_2$ and 20–90 mol % $TiO_2$, but again poor results were encountered.

Further attempts to derive advantages from the properties of palladium oxide include:

a composite coating of palladium oxide with tin oxide and ruthenium oxide and possibly with titanium oxide in specified proportions (U.S. Pat. No. 4,061,558);

palladium oxide combined with tin, antimony and/or titanium oxide (Japanese Patent Application Open No. 52-58075);

an underlayer e.g. of platinum or $RuO_2$ topcoated with palladium and tin oxides (Japanese Patent Application Open No. 52-68076);

palladium oxide with a small amount of $ZrO_2$ or $CeO_2$, possibly up to 20 mol % of the PdO being substituted by, e.g. $RuO_2$ (Japanese Patent Application Open No. 53-33983);

a partially oxidized platinum-palladium alloy (U.K. Patent Specification No. 1 549 119);

palladium oxide and platinum produced by thermal decomposition (Japanese Patent Application Open No. 52-86193);

pre-formed palladium oxide dispersed in platinum produced by thermal decomposition (Japanese Patent Application Open Nos. 54-43879 and 54-77286);

a sub-layer of platinum coated with PdO, $CeO_2$ and $TiO_2$ (Japanese Patent Publication Open No. 54-102290); and a coating of PdO-Pt-$SnO_2$ (Japanese Patent Publication Open No. 55-97486).

These publications illustrate the efforts made to employ palladium oxide on account of its good technical properties, in particular its low chlorine evolution potential and high oxygen evolution potential, and its moderate cost. However, none of the expedients or combinations proposed to date has effectively realized the potential advantages of palladium oxide because of the inherent difficulties involved and in particular its poor stability.

DISCLOSURE OF INVENTION

The invention, as set out in the claims, provides an improved electrode making optimum use of the electrocatalytic properties of palladium oxide, this electrode having an electrocatalyst composed of 22–55 mol % of ruthenium oxide, 0.2–22 mol % palladium oxide and 44–77.8 mol % titanium oxide.

When produced in the usual way by thermally decomposing a paint solution comprising thermally decomposable compounds of the three metals in the desired proportions, a mixed oxide electrocatalyst of this composition is found to consist of a solid-solution or mixed crystal of ruthenium-titanium oxide in which the palladium oxide is finely divided in a stabilized form. Such electrocatalytic coatings, in particular on a valve-metal substrate such as titanium, have practically the same characteristic mud-cracked appearance and morphology as the ruthenium-titanium oxide solid solution coating without palladium oxide, and maintain the same excellent wear characteristics of the conventional ruthenium-titanium oxide coating enhanced by the addition of the stabilized palladium oxide which in particular provides a high oxygen overpotential and hence enhances the efficiency of the electrode for chlorine or hypochlorite production.

This improved electrocatalyst is particularly advantageous as an electrode coating for chlorine and hypochlorite production, particularly in instances where it is important to suppress unwanted oxygen evolution as in the electrolysis of dilute brines and in membrane cells. The electrocatalyst may, as mentioned above, form a coating on a conductive electrode substrate but it may also advantageously be preformed into a powder and incorporated in or carried by an ion-selective membrane or other separator against which a current feeder is pressed, in so-called SPE (Solid Polymer Electrolyte) or Narrow Gap Cell technology.

A particularly preferred composition of the electrocatalyst is 22–28 mol % ruthenium oxide 1–12 mol % palladium oxide and 60–77 mol % titanium oxide, in which range an optimum effect in terms of stability and oxygen-inhibition appears to be achieved.

Also, it has been established that an excellent effect of the palladium oxide is achieved when the molar ratio of palladium oxide to ruthenium oxide is within the range 1:2 to 1:20.

In another preferred embodiment, when the electrocatalyst forms a coating on a conductive substrate, on top of the electrocatalytic coating is superimposed an electrocatalytically-inert porous layer of a ceramic oxide, in particular a valve metal oxide such as titanium or tantalum oxide. Such protective layers act as a diaphragm and apparently synergistically combine with the palladium-oxide containing electrocatalytic coating to enhance its selectivity (oxygen inhibition) whilst appreciably increasing the lifetime. Best results have been obtained with a protective topcoating of titanium dioxide.

BEST MODES FOR CARRYING OUT THE INVENTION

The invention will be further described in the following Examples and compared with the prior art.

EXAMPLE 1

A paint solution was prepared from:

0.537 g $RuCl_3$.aq.
0.128 g $PdCl_2$
1.876 g $Ti(BuO)_4$
0.25 ml HCl (conc.)
3.75 ml Butanol This paint solution was applied by brushing to a pre-etched titanium coupon. Ten coats were applied, each coat being dried for 5 minutes at 120° C. and baked at 500° C. for 10 minutes. The electrocatalytic coating produced contained approximately 25 mol % of ruthenium oxide, 9 mol % of palladium oxide and 66 mol % of titanium oxide. The coating had the same characteristic "mud-cracked" appearance as a comparable prior-art coating without the palladium oxide. Analysis of the coating by X-ray diffraction revealed that it consisted of a solid-solution or mixed-crystal of ruthenium-titanium oxide in which the palladium oxide was finely dispersed as a separate phase.

The electrode was subjected to an accelerated lifetime test in 150 gpl $H_2SO_4$ at 50° C. with an anode current density of 7.5 kA/m$^2$. Its lifetime was 140 hours compared to 23 hours for a comparable prior-art electrode (ruthenium-titanium oxide coating without palladium oxide, having the same precious metal loading).

EXAMPLE 2

An electrode was prepared in a similar manner to the electrode of Example 1 but using a paint to give a final approximate composition of 28.5 mol % ruthenium oxide, 3 mol % palladium oxide and 68.5 mol % titanium oxide. The baking temperature was 525° C. The electrode was then topcoated with a layer of tantalum pentoxide by applying a solution of tantalum pentachloride in amyl alcohol and heating to 525° C. for ten minutes. The electrode was subjected to an accelerated test in a swimming pool type hypochlorite generator in a dilute brine. The electrode operated at a chlorine current efficiency of 80–85% for 24 days compared to a 65% efficiency for 15 days using the best commercially-available prior art electrode.

EXAMPLE 3

A topcoated electrode similar to that of Example 2 but containing approximately 0.3 mol % palladium oxide, 29.7 mol % ruthenium oxide and 70 mol % titanium oxide was compared to an electrode with a similar 30:70 mol % ruthenium-titanium oxide coating with the same topcoating. The inclusion of 0.3 mol % palladium oxide was found to double the electrode lifetime in the sulphuric acid lifetime test of Example 1.

COMPARATIVE EXAMPLE

Example 1 of Japanese Patent Application Open No. 51-116182 was repeated to provide a titanium electrode with a coating nominally made up of 16 mol % palladium oxide, 4 mol % ruthenium oxide and 80 mol % titanium oxide. Four applications of the paint solution were made to give a precious metal loading of approx. 1.4 g/m$^2$ Pd and 0.35 g/m$^2$ Ru. At a low current density (200 A/m$^2$) the measured overpotentials for chlorine and oxygen evolution were promising (0.02 and 0.9 V, respectively), but when an attempt was made to measure the lifetime of the electrode in 150 g/l $H_2SO_4$ at 50° C. with an anode current density of 7.5 kA/m$^2$, as in Example 1, the electrode failed almost immediately. An attempt was made to improve this by using a more concentrated (2.5x) paint and increasing the number of applied layers from 4 to 8 but the lifetime was only 8 hours. A further attempt to produce a useful electrode was made by increasing the amount of ruthenium to give a coating containing approx. 13.8 mol % palladium oxide, 17.2 mol % ruthenium oxide and 69 mol % titanium oxide. However, the lifetime was still inferior to that of a corresponding ruthenium-titanium oxide electrode.

The first comparative example electrode coating was also examined by X-ray diffraction which revealed the presence of palladium oxide, ruthenium oxide and titanium oxide as three separate phases. No evidence of a ruthenium-titanium oxide solid solution was found. With the second comparative example electrode, the major components were the single oxides with a trace of a ruthenium-titanium oxide solid solution. In both cases, most of the titanium oxide was present in the undesirable anatase form.

We claim:

1. An electrode comprising an electrocatalyst based on the oxides of ruthenium, palladium and titanium, characterized in that the electrocatalyst consists of a three-component mixed oxide containing:

22–55% Ru
0.2–22% Pd and
44–77.8% Ti calculated as molar percentages of the respective oxides.

2. The electrode of claim 1, wherein the electrocatalyst consists of 22–28% Ru, 1–12% Pd and 60–77% Ti calculated as molar percentages of the respective oxides.

3. The electrode of claim 1 or 2, wherein the molar ratio of palladium oxide to ruthenium oxide is within the range 1:2 to 1:20.

4. The electrode of claim 1 or 2, wherein the electrocatalyst is a coating of mud-cracked configuration on a valve metal substrate.

5. The electrode of claim 4, wherein an electrocatalytically inert porous layer of a ceramic oxide is superimposed on the electrocatalyst coating.

6. The electrode of claim 1 or 2, wherein the electrocatalyst is carried by or incorporated in a separator.

7. The electrode of claim 3, wherein the electrocatalyst is a coating of mud-cracked configuration on a valve metal substrate.

8. The electrode of claim 7, wherein an electrocatalytically inert porous layer of a ceramic oxide is superimposed on the electrocatalytic coating.

9. The electrode of claim 3, wherein the electrocatalyst is carried by or incorporated in a separator.

10. The electrode of claim 1 wherein the electrocatalyst consists of a coformed mixture of the oxides in the form of solid solution of ruthenium-titanium oxides in which the palladium oxide is finely distributed.

* * * * *